US006460381B1

(12) United States Patent
Yoshida et al.

(10) Patent No.: US 6,460,381 B1
(45) Date of Patent: Oct. 8, 2002

(54) WASHING MACHINE OR AN APPARATUS HAVING A ROTATABLE CONTAINER

(75) Inventors: Shigeki Yoshida, Otsu; Koichi Yoshizaki, Kusatsu; Takao Kuraseko; Yuka Yoshida, both of Otsu; Kazushige Kakutani, Moriguchi; Keiji Kishimoto, Hirakata; Hideaki Aoki, Kyoto; Kazuya Hiyamizu, Hirakata, all of (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/526,882

(22) Filed: Mar. 16, 2000

(30) Foreign Application Priority Data

| | | |
|---|---|---|
| Mar. 29, 1999 | (JP) | 11-086815 |
| Apr. 2, 1999 | (JP) | 11-096130 |
| Sep. 29, 1999 | (JP) | 11-277068 |

(51) Int. Cl.[7] ..... D06F 33/02

(52) U.S. Cl. ..... 68/12.04; 68/12.05; 68/12.06; 68/12.27

(58) Field of Search ..... 68/12.04, 12.05, 68/12.06, 12.27

(56) References Cited

U.S. PATENT DOCUMENTS

| | | | | |
|---|---|---|---|---|
| 5,375,437 A | * | 12/1994 | Dausch et al. | 68/12.06 |
| 6,065,170 A | * | 5/2000 | Jang | 68/12.04 X |

FOREIGN PATENT DOCUMENTS

| | | | | |
|---|---|---|---|---|
| GB | 2087438 | * | 5/1982 | 68/12.04 |
| JP | 63-206283 A | | 8/1988 | |
| JP | U-1-105834 | | 7/1989 | |
| JP | 5-84382 A | | 4/1993 | |
| JP | 9-94380 | | 8/1997 | |

* cited by examiner

*Primary Examiner*—Philip Coe
(74) *Attorney, Agent, or Firm*—Oliff & Berridge, PLC

(57) ABSTRACT

A washing machine according to the present invention includes a pressure sensor provided at a rod holding plate holding a suspension rod with which an outer tub is suspended. The pressure sensor is constructed so that a coil is wound around a magnetostrictive element whose magnetic characteristic changes when it is expanded, compressed or twisted by an external force. The change in the magnetic characteristic is converted to the change in the inductance of the coil, and an oscillating signal of a frequency corresponding to the inductance generated. Based on the frequency of the signal, the load on the pressure sensor is detected. Before supplying water, the amount of the laundry contained in a wash-and-extraction tub is detected based on the output of the pressure sensor, and an object water level corresponding to the amount is determined. After that, a water supply valve is opened to start supplying water into the wash-and-extraction tub. The weight of water supplied is monitored based on the output of the pressure sensor, and the weight is converted to a water level. When the monitored water level has attained the object water level, the water supply is stopped. Thus, the pressure sensor functions not only as a load detector but also as a level sensor.

6 Claims, 13 Drawing Sheets

WASHING MACHINE OR AN APPARATUS HAVING A ROTATABLE CONTAINER

FIELD OF THE INVENTION

The present invention relates to a washing machine or an apparatus having a rotatable container.

BACKGROUND OF THE INVENTION

Washing machines are provided with various kinds of sensors and detectors such as: a load detector for detecting the weight of the laundry contained in a wash-and-extraction tub (which is referred to as "laundry tub"); a level sensor for measuring the water level in the laundry tub; and a vibration sensor for detecting an abnormal vibration which occurs in the course of an extracting process if the laundry tub is rotated with the laundry being distributed unevenly.

Japanese Unexamined Patent Publication No. S63-206283 discloses one of conventional methods of detecting the weight of the laundry. The method includes steps of:

turning on a motor for rotating a pulsator provided at the bottom of the laundry tub with no water held in the tub and then turning off the motor after a preset time period; counting pulse signals produced synchronously with the rotation of the motor after the motor is turned off;

and calculating the weight of the laundry based on the number of pulses produced until the motor stops the inertial rotation. In this process, the pulsator stops sooner as the weight of the laundry is larger. Accordingly, the weight of the laundry is determined larger as the number of pulses is smaller. By such a method of detecting the weight of the laundry utilizing the inertial rotation of the pulsator, however, it is difficult to improve the accuracy of detection because the detected value varies depending on the quality or condition of the fabric of the laundry. Another problem is that the laundry is often damaged due to the friction between the pulsator and the laundry.

In some of the conventionally proposed methods, a weight sensor is used for directly measuring the weight of the laundry contained in the washing tub, instead of detecting the weight indirectly. For example, Japanese Unexamined Patent Publication No. H5-84382 discloses a washing machine, where a weight sensor composed of a spring, coil, core and other elements is provided on suspension rods with which the washing tub is suspended. According to this construction, when the load on the suspension rods change and the suspension rods move up or down, the length of the part of the core in the coil held at a fixed position changes, and the inductance of the coil changes accordingly.

When the above-described weight sensor is used, however, the damping design becomes complicated because two types of spring (one for damping and the other for detecting weight) are provided at one or some of the suspension rods while a single spring is provided at other rods. Also, the weight sensor itself may increase the vibration, because the spring used in the weight sensor has its own natural frequency. Also, the use of the above described weight sensor is not preferable in respect of designing the washing machine with smaller size and greater capacity, because the weight sensor is normally large in size so that it occupies a substantial space in a body housing of the washing machine. Also, the characteristics of the spring of the weight sensor changes or deteriorates as the spring ages, which deteriorates the detection accuracy.

Another problem concerning the weight sensor is as follows. In the above-described washing machine, the weight sensor is used for detecting not only the weight of the laundry contained in the laundry tub but also the weight of water supplied and held in the outer tub. The weight of the laundry is several kilograms at most, while that of water held in the outer tub is almost ten or more times as great as that of the laundry. When the weight sensor is designed to detect a weight as great as several tens of kilograms, the detection accuracy of a weight as small as the weight of the laundry becomes inevitably low. When, on the other hand, the weight sensor is designed to detect a weight as small as the weight of the laundry with adequately high accuracy, the maximum weight that the weight sensor can detect cannot be as great as that of the water held in the outer tub. Thus, it is difficult to detect both the weight of the laundry and that of water held in the outer tub with the above-described weight sensor.

SUMMARY OF THE INVENTION

Taking account of the above-described problems, one object of the present invention is to provide a washing machine with a small-sized load sensor having high detection accuracy without introducing difficulties in the damping design and without causing unfavorable effect on the rotation of the laundry tub. Another object of the present invention is to utilize the load sensor not only for detecting the weight of the laundry but also for detecting the weight of water and further for detecting water level in the outer tub. Still another object is to provide a washing machine having a sensor whereby the vibration of the laundry tub and/or the outer tub is detected with high accuracy during the extracting process where the laundry tub spins at high speed.

For solving the above-described problems, a washing machine according to the present invention utilizes a pressure sensor constructed with a magnetostrictive element whose magnetic characteristic changes depending on the changing rate or magnitude of an external force exerted on it. A pressure sensor of this type is disclosed, for example, in the full text of Japanese Unexamined Utility Model Publication No. H1-105834.

Thus, in a washing machine including a body housing, an outer tub suspended in the body housing and a wash-and-extraction tub rotatably provided in the outer tub, the washing machine according to a first aspect of the present invention (which is referred to as "first washing machine" in this specification) includes a pressure sensor placed at a position where it experiences an external force due to the weight of the laundry contained in the wash-and-extraction tub and the weight of water held in the outer tub. The pressure sensor is constructed with a magnetostrictive element on which the external force is exerted and a coil placed close to the magnetostrictive element. The coil is used for detecting a change in the magnetic characteristic of the magnetostrictive element due to the external force. A measuring part receives an output of the coil of the pressure sensor and measures the weight of the laundry and the weight of the water based on the output. An operation controller controls the water supply into the outer tub based on the weight measured by the measuring part. First, before the start of the water supply, the operation controller determines an object amount of water to be supplied into the outer tub according to the weight of the laundry. Next, while the water is being supplied, the operation controller monitors the weight of water with the measuring part and controls the water supply with respect to the object amount of water.

The above-described pressure sensor is advantageous in that it is small and lightweight, and that it has a broad detection range. Since it occupies a very small space, the pressure sensor can be placed anywhere in the washing machine and allows designing washing machines of smaller in size and greater in capacity. Also, the pressure sensor never functions as a source of vibration because it includes no moving element such as a spring. Since no moving element is used, further, detection accuracy never deteriorates due to degeneration of the moving element.

The above-described pressure sensor has such an advantage that it can detect a broad range of external force and that its sensitivity is higher as the external force is smaller. Therefore, when it is desired to measure both the weight of the laundry and the weight of water with a single pressure sensor, the above-described sensor may be preferably used. For example, based on the output of the above-described pressure sensor, the measuring part not only measures the weight of the laundry with high sensitivity before water is supplied, but also measures the weight of water, which increases beyond the weight of the laundry after the water is supplied. The weight of water can be translated into water level held in the outer tub. Thus, the measuring part with the pressure sensor not only functions as a load detector but also as a level sensor, so that there is no need to provide a conventional level sensor using a pressure hose or other devices.

The above-described pressure sensor may be placed at such a position where it experiences not only an external force due to the weight of the laundry and the water, but also another external force resulting from an eccentric load due to an uneven distribution of the laundry contained in the laundry tub and a vibration of the laundry tub due to the eccentric load. According to such a construction, the measuring part can measure not only the weight of the laundry and the water, but also the eccentric load and the vibration due to the eccentric load, based on the output of the pressure sensor.

The measuring part may be constructed so that it measures only the eccentric load and/or the vibration based on the output of the coil of the pressure sensor.

In a mode of the first washing machine, the measuring part is constructed so that the change in the magnetic characteristic of the magnetostrictive element is detected by a change in the inductance of the coil. For example, it is detected by a change in the oscillation frequency of an LC oscillator including the coil. In general, the inductance of a coil changes depending on the number of turns of the coil. When the change in the inductance of the coil is detected as described above, the amount of change in the inductance varies according to the number of turns. Thus, as for the present case, it is preferable to provide a plurality of coils constructing a coil assembly whose inductance is variable by selecting one, some or all of the coils. According to this construction, the sensitivity of the pressure sensor can be arbitrarily determined according to an object to be detected by selecting one, some or all of the coils.

For example, when the weight of the laundry and the weight of water are detected using the same pressure sensor as described above, the weight of the laundry is detected with higher sensitivity, and the weight of water is detected with lower sensitivity.

In the first washing machine, the pressure sensor may be located at various places in the washing machine, as explained above. For example, the pressure sensor may be provided in at least one of the rod holders which hold the suspension rods, or in at least one of the feet supporting the washing machine on the floor. For detecting the weight of the laundry and the weight of water, it is preferable to provide the pressure sensor in the rod holder or in the foot because these parts are directly affected by the external force due to the weight of the laundry and the weight of water.

It is preferable to provide the pressure sensor in every rod holder or in every foot of a washing machine and measure the whole weight based on the outputs of all the pressure sensors. By this construction, the detection accuracy is improved.

It is not essential for the present invention to provide the pressure sensors in all of the plural rod holders or feet. For example, the weight of the laundry, the weight of water, the eccentric load or the vibration may be inferred based on the output of a single pressure sensor provided in one of the plural rod holders or feet. According to such a construction, the production cost is reduced. Under such a construction, it is further preferable to detect the weight a plurality of times while rotating the laundry tub at low speed and infer the weight of the laundry, the weight of water, the eccentric load or the vibration based on the plurality of detected values. According to such a construction, even though all the suspension rods or feet are not provided with the pressure sensor, the undesirable effect of the unbalance in the distribution of the weight of the laundry is cancelled, so that a high detection accuracy is obtained.

In the first washing machine, when only the eccentric load and/or the vibration is detected, the pressure sensor is preferably placed at such a position where the vibration appears with a large magnitude in the course of the washing, rinsing or extracting process. For example, the pressure sensor may be attached to the body housing. In this case, the vibration of the body housing is converted into an external force, which exerts on the pressure sensor and is detected by the pressure sensor.

In a washing machine including a body housing, an outer tub suspended in the body housing and a wash-and-extraction tub rotatably provided in the outer tub, the washing machine according to a second aspect of the present invention (which is referred to as "second washing machine" in this specification) includes a pressure sensor placed at a position where it experiences an external force due to the load on the outer tub and the vibration of the outer tub. The pressure sensor is constructed with a magnetostrictive element on which the external force is exerted and a coil placed close to the magnetostrictive element. The coil is used for detecting a change in the magnetic characteristic of the magnetostrictive element due to the external force. A measuring part receives output of the coil of the pressure sensor and measures the load on and vibration of the outer tub.

The measuring part of the second washing machine may be constructed so that its measuring mode is selectable between a weight-measuring mode for measuring the load on the outer tub and a vibration-measuring mode for measuring the vibration. For example, the measuring part is constructed to run in the vibration-measuring mode while the laundry tub is rotating and to run in the weight-measuring mode when the laundry tub is halted. According to such a construction, abnormal rotation is detected with the measuring part in the vibration measuring mode during the rotation of the laundry tub, while the weight of the laundry is measured by the measuring part in the weight-measuring mode when the laundry tub is halted, particularly at the beginning of the operation.

The washing machine may be constructed so that the rotation is determined as abnormal when the magnitude of the vibration measured by the measuring part is greater than a preset threshold value. When the laundry tub rotates with an eccentric load due to uneven distribution of the laundry or other factors, the magnitude of vibration measured by the measuring part is greater as the amount of eccentricity is greater. So, the abnormal rotation can be detected based on the magnitude of vibration.

The above-described washing machine may be preferably constructed to determine the threshold value based on the load on the outer tub measured by the measuring part in the weight-measuring mode. Even when the amount of eccentricity is equal, the magnitude of vibration measured by the measuring part varies depending on the weight of the laundry. Taking this into account, the threshold value is determined based on the load on the laundry tub, whereby the instability in the threshold value of the eccentricity is reduced and the determination of abnormal rotation becomes more reliable.

The measuring part of the second washing machine may be constructed to have a weight-and-vibration-measuring mode for measuring the load on the outer tub and the vibration of the outer tub at the same time. With such a construction, the washing machine may be provided by a controller that determines a threshold value based on the load measured by the measuring part and determines the rotation as abnormal when the magnitude of vibration is greater than the threshold value. According to such a construction, the magnitude of the load for determining the threshold value is obtained simultaneously with the magnitude of vibration which is the object of the abnormal rotation detecting process. Thus, the threshold value is determined without being influenced by a time variability of the load.

When the outer tub is suspended by plural suspension rods, the pressure sensor may be provided in at least one of the suspension rods in such a manner that an end of the pressure sensor is received by an end of the suspension rod and the other end of the pressure sensor is received by the body housing. Any suspension rod equipped with the pressure sensor may further comprise a projection extending from the suspension rod toward the outer tub. According to such a construction, when the laundry tub rotates abnormally or eccentrically due to uneven distribution of the laundry, the outer tub tilts and collides with the projection.

The shock of the collision is transmitted to the pressure sensor via the suspension rod, so that the abnormal rotation is detected from the output of the pressure sensor. It is preferable to form the side wall of the outer tub thicker at the part where the side wall collides with the projection than elsewhere, so that the dent or wear of the outer tub is alleviated.

When the present invention is applied to a washing machine having a pulsator for producing water current in the outer tub, the washing machine may be constructed so that the speed of the pulsator is decreased to weaken the water current when a vibration of magnitude greater than a preset level is detected in the course of the washing or rinsing process. Such a construction is preferable in that not only the vibration is reduced but also the water is prevented from being scattered around the washing machine. Also, the washing machine may be constructed so that an unbalance-correcting operation is carried out for redistributing the laundry in the laundry tub when a vibration of magnitude greater than a preset level is detected with the pressure sensor during the extracting process.

It should be noted that the present invention is applicable not only to the washing machine as described above but also to other types of apparatuses having a container which is rotatable about a horizontal or vertical axis, similar to the washing machine. Thus, an apparatus according to the present invention is constructed so that a pressure sensor constructed with a magnetostrictive element is provided at a position where the pressure sensor experiences an external force due to a load on the container or a vibration resulting from the rotation of the container. When the present invention is applied to a drying machine having a rotatable drum, the weight of the laundry in the drum is detected, and the vibration is detected during the operation.

DETAILED DESCRIPTION OF PREFERRED EMBODIMENTS

Embodiments of the present invention are described referring to the attached drawings.

Figure 1:
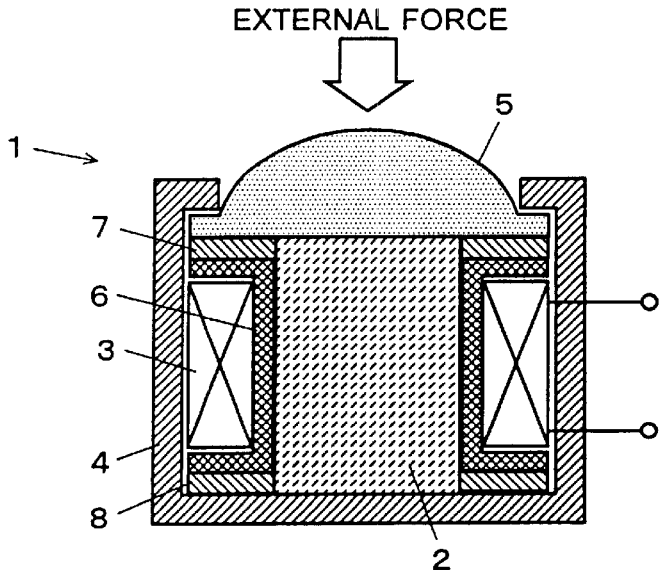
FIG. 1 shows a vertical section of an example of a pressure sensor used in the washing machine according to the present invention.
Figure 2:
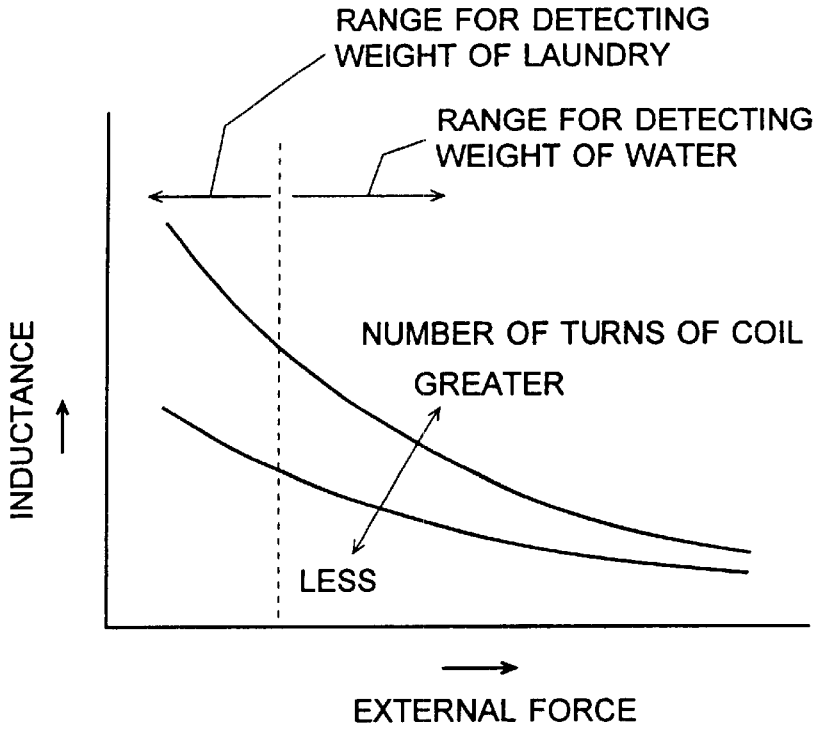
FIG. 2 is a graph showing a relation between the external force applied to the pressure sensor and the inductance.

To begin with, an example of a pressure sensor used in the washing machine according to the present invention is described referring to FIGS. 1 and 2.

FIG. 1 shows a vertical section of the pressure sensor. The pressure sensor 1 has a core 2 consisting of a cylindrical giant magnetostrictive element. A bobbin 6 is fit over the side wall of the core 2. A coil 3 is wound around the bobbin 6. A pair of elastic rubber rings 7 and 8 are put on the upper and lower end faces of the bobbin 6. A cylindrical case 4 with a closed bottom encloses the coil 3. A pressure receptor 5 is set at the open end of the case 4 with its bottom put the top of the core 2. The top face of the receptor 5, or the face for receiving an external force, is shaped hemispherical and is designed to protrude from the open end of the case 4 to the outside. By such a structure, the external force is received by the receptor 5 at a point and is transmitted evenly onto the top face of the core 2.

The giant magnetostrictive element used as the core 2 is an element whose magnetic characteristic changes when it is mechanically deformed (e.g. compressed, expanded or twisted) by an external force, where the change in the magnetic characteristic depends on the changing rate or magnitude of the external force. When, for example, an external force is exerted on the receptor 5 of the pressure sensor 1 as shown in FIG. 1, the receptor 5 presses the top of the core 2, and the self-inductance of the coil 3 changes depending on the deformation of the core 2. FIG. 2 is a graph showing an example of the relation between the magnitude of the external force and the self-inductance in the pressure sensor 1. FIG. 2 shows that the amount of change in the self-inductance with respect to the same amount of change in the external force is greater as the external force is smaller. That is, the pressure sensor 1 has a non-linear characteristic such that its sensitivity is higher as the external force is smaller. Also, it should be noted that, when the same giant magnetostrictive element is used, the self-inductance is larger as the number of turns of the coil is greater, so that the inclination of the characteristic curve becomes larger, as shown in FIG. 2.

[Embodiment 1]

An embodiment of the washing machine including the pressure sensor 1 is described.

Figure 3:
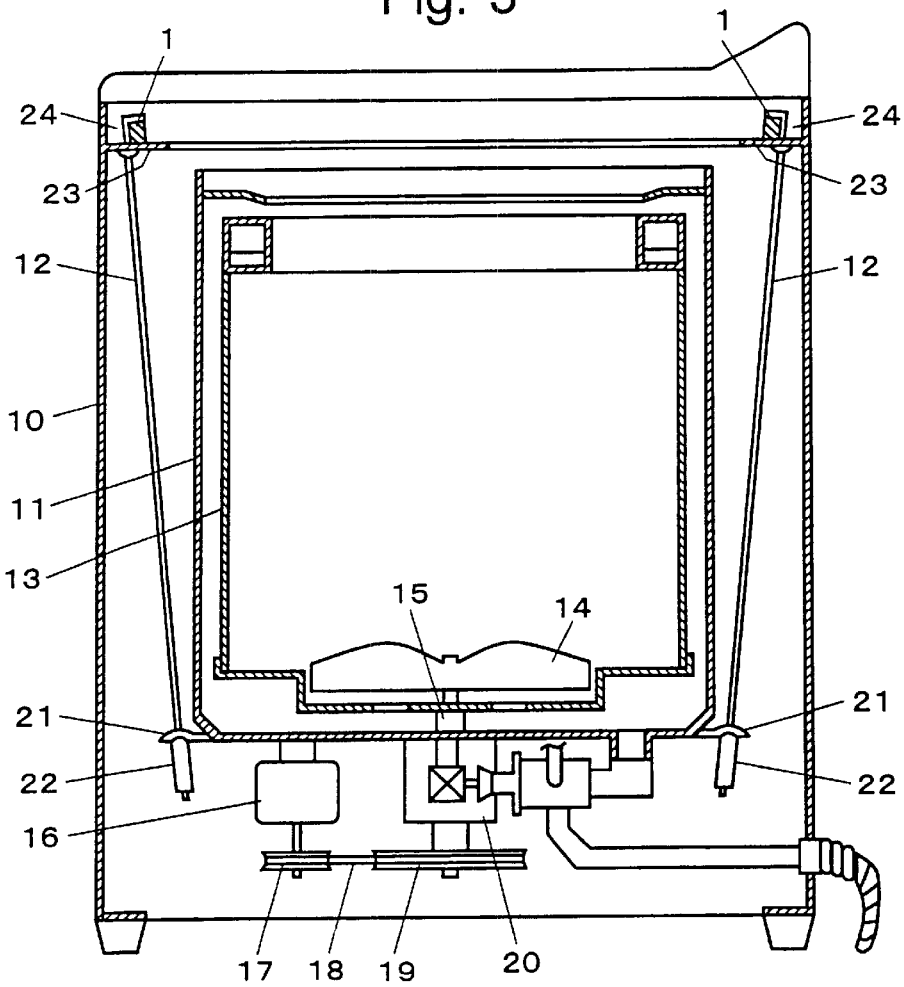
FIG. 3 shows a vertical section of a washing machine of Embodiment 1.

FIG. 3 shows a vertical section of the washing machine of Embodiment 1. The washing machine has a body housing 10, in which an outer tub 11 is suspended with four suspension rods 12 (FIG. 3 shows only two of them). A laundry tub 13 having perforations in its side wall is rotatably mounted on a main shaft 15 in the outer tub 11. A pulsator 14 for agitating the water is provided at the bottom of the laundry tub 13. A motor 16 is attached to the lower face of the bottom of the outer tub 11. A motor pulley 17, V-belt 18, main pulley 19 and power-switching mechanism 20 are provided to transmit the rotation of the motor 16 to the laundry tub 13 and the pulsator 14.

The fixation structure of the suspension rod 12 is as follows. The lower end of the suspension rod 12 protrudes through the fixation plate 21 extending outwards from the bottom of the outer tub 11, and a damper 22 having a compression spring (not shown) is attached to the lower end. The upper end of the compression spring is fixed to the fixation plate 21.

The weight of the outer tub 11 is sustained via the fixation plate 21 by the damper 22, and the vibration or oscillation of the outer tub 11 is absorbed by the spring which is compressed or expanded according to the load. The upper end of the suspension rod 12 is held with a rod holding part 24 by another fixation plate 23 extending inwards from the body housing 10, where the suspension rod 12 is allowed to move up and down. The pressure sensor 1 is attached to the rod holding part 24 so that it receives the load acting on the suspension rod 12.

The pressure sensor 1 is attached to each of the four rod holding parts 24 holding the four suspension rods 12, respectively. Each of the four rod holding parts 24 receives a share of the weight of the outer tub 12, and each of the four pressure sensors 1 experiences the share of the weight as the external force.

Figure 4:
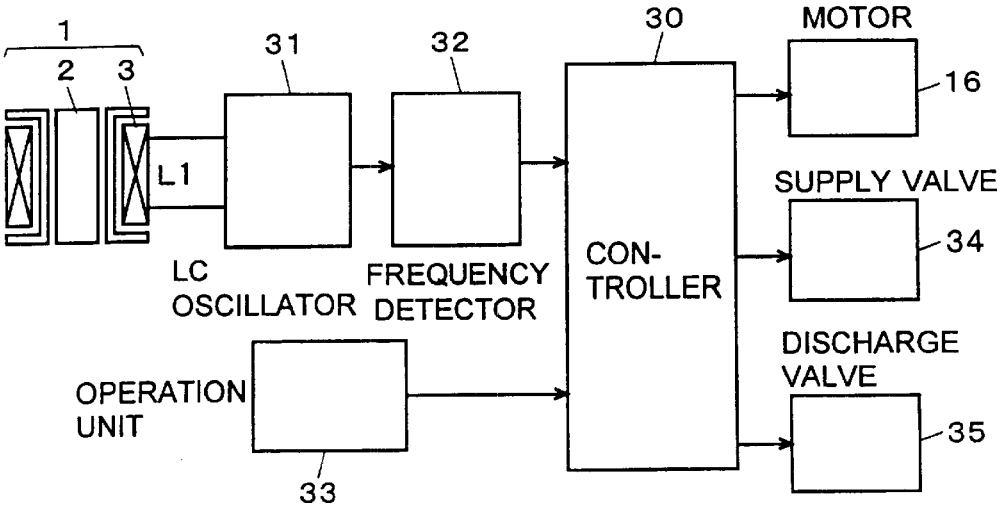
FIG. 4 shows the electrical system of the main part of the washing machine of Embodiment 1.

FIG. 4 shows the electrical system of the main part of the washing machine. In this system, a controller 30 includes a central processing unit (CPU) and other elements. The controller 30 receives operation signals from an operation unit 33 and controls the rotation of the motor 16, the open/close operation of a water supply valve 34 and a discharge valve 35, etc. The coil 3 of the pressure sensor 1 attached to the suspension rod 12 is connected to an LC oscillator 31. Though not shown in FIG. 4, the system includes four LC oscillators 31 connected to the coils 3 of the four pressure sensors 1, respectively. The LC oscillator 31 includes a condenser (not shown) constructing a resonance circuit with the coil 3 and generates an oscillating signal with a frequency depending on the inductance LI of the coil 3. A frequency detector 32 detects the frequency of the oscillating wave and sends the detected value to the controller 30. Thus, the controller 30 receives four channels of detection signals, each of which indicates the inductance of each of the coils 3 of the pressure sensors 1. The controller 30 calculates the sum of the four detection signals received from the four frequency detectors 32 or processes the signals by some other method, and calculates the weight of the laundry, the weight of water, the eccentric load, etc. For example, when the weight of the laundry or the weight of water is to be detected, the sum of the detected values are calculated. Therefore, when only the weight of the laundry and/or the weight of water is detected, the electrical system may be constructed so that the coils 3 of the four pressure sensors 1 are connected in series to add their inductance values together and an oscillating signal having a frequency corresponding to the sum of the inductance values is generated with a single LC oscillator.

Figure 5:
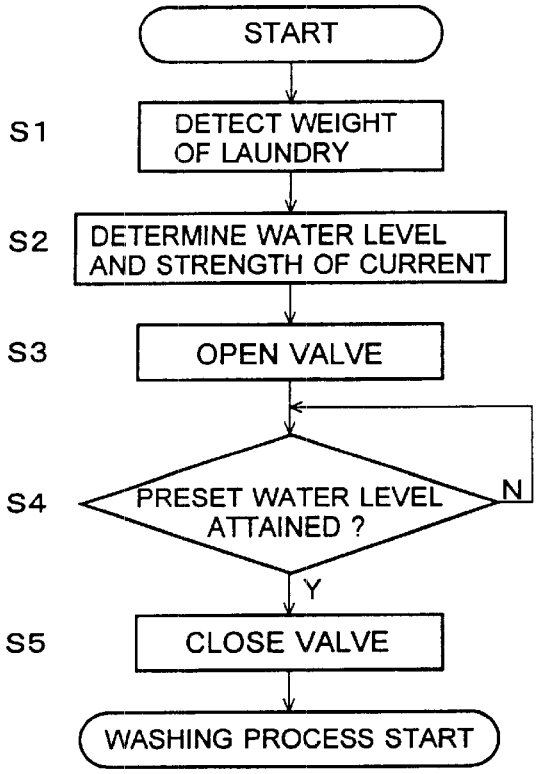
FIG. 5 is a flowchart showing control steps of the washing machine of Embodiment 1 from the start of the operation to the start of the washing process.

FIG. 5 is a flowchart showing control steps of the washing machine. Referring to FIG. 5, the control steps of the washing machine of Embodiment 1 is described from the start of the operation to the start of washing process.

When a user puts the laundry into the laundry tub 13 and commands the controller 30 to start the operation through the operation unit 33, the controller 30 first carries out a load detecting process (Step S1). When the laundry is put into the laundry tub 13, the load on the suspension rod 12 increases accordingly, and the external force which the pressure sensor 1 receives at the receptor 5 also increases. Then, the inductance L1 changes, and the oscillation frequency of the LC oscillator 31 changes. The controller 30 reads the oscillation frequency value from the frequency detector 32, and calculates the weight of the laundry by, for example, referring to a table showing the relation between the frequency and the load. The table is prepared by experiments and stored in a memory beforehand.

The controller 30 determines a water level and a strength of water current based on the load detected (Step S2), and opens the water supply valve 34 to start supplying water into the outer tub 11 (Step S3). As the water is being supplied in the outer tub 11, the external force that the pressure sensor 1 receives at the receptor 5 further increases due to the weight of water. The controller 30 determines whether the frequency value read from the frequency detector 32 has attained an object frequency corresponding to a weight of water equivalent to the above-determined water level (Step S4). When the oscillation frequency has attained the object frequency, the controller 30 closes the water supply valve 34 (Step S5). Then, the controller 30 drives the motor 16 to rotate the pulsator 14 at a speed corresponding to the above-determined strength of water current, whereby the washing process is started.

As described above, the washing machine of Embodiment 1 is constructed so that the pressure sensor 1 is used not only for detecting the weight of the laundry but also for detecting the water level by converting the weight of water into water level. Therefore, there is no need to provide such a level sensor as used in conventional washing machines.

In general, the weight of the laundry is about 7–8 kilograms at most. When the water level is high, the amount water attains several tens of liters and, accordingly, the water weighs several tens of kilograms. Thus, the weight of water is far greater than that of the laundry, and the necessary range of detection is should be large. As for the detection accuracy, on the other hand, the weight of water may be detected with rather low accuracy, while the weight of the laundry is required to be detected with accuracy as high as 0.5–1.0 kilogram. FIG. 2 shows that the pressure sensor 1 has such a characteristic that the sensitivity is higher as the external force is smaller. According to this characteristic, the sensitivity is high in detecting the weight of the laundry, while it is low in detecting the water level. Thus meeting the requirements described above, the pressure sensor 1 is preferably used for detecting both the weight of the laundry and the water level.

When the weight of the laundry and the weight of water are to be detected as described above, the variable range of the frequency of the LC oscillator 31 becomes broader, and a more complex frequency detection circuit may be needed. On the contrary, when the variable range of the frequency is narrow, the sensitivity decreases accordingly, and an adequate sensitivity may not be assured particularly for the detection of the weight of the laundry. For reducing the variable range of frequency while maintaining adequate sensitivity, the pressure sensor 1 may be modified as follows. FIG. 2 shows that the inductance depends on the number of turns of the coil. Taking this into account, the pressure sensor 1 is provided with two (or more) independent coils having different number of turns wound around the giant magnetostrictive element 2, and the number of turns of the coil is changed according to necessity when the oscillating signal is generated with the LC oscillator 31. As described above, the necessary detection range for the weight of water is far broader than that for the weight of the laundry. So, when the external force is within the detection range for the weight of water, the number of turns of the coil is reduced. By this method, the amount of change in the inductance for the same amount of change in the external force becomes smaller, and the variable range of the inductance becomes relatively narrow with respect to a broad range of external force. In this case, the detection sensitivity is low, which, however, causes no problem because high sensitivity is not needed for the detection of the weight of water. When, on the other hand, the external force is within the detection range for the weight of the laundry, the number of turns of the coil is increased to secure a high sensitivity. An example of the method of changing the number of turns of the coil will be described later in Embodiment 3.

In the washing machine of Embodiment 1, the pressure sensor 1 may be further utilized for detecting the eccentric load and/or vibration during the extracting process.

Before starting the extracting process, if the laundry contained in the laundry tub 13 is unevenly distributed around the main shaft, the external force is exerted onto the four pressure sensors 1 unevenly. So, for example, the controller 30 calculates the difference between the maximum weight and the minimum weight of the four weights detected by the four pressure sensors 1 and, when the difference is greater than a preset reference value, it determines that the eccentric load is too large. In that case, the controller 30 carries out an operation where an appropriate amount of water is supplied into the outer tub 11 and the pulsator 14 is rotated temporarily. As a result, the laundry is loosened, and its distribution changes. After that, the above determination process is carried out again.

Even when the eccentric load is small before starting the extracting process, the vibration may arise later as the extraction of water proceeds during the extracting process where the laundry tub rotates at high speed. When the vibration becomes too large, the outer tub 11 collides with the inner wall of the body housing l0, causing an abnormal noise. Also, the main shaft 15 may be damaged by an abnormally large load exerted on it. Therefore, it is preferable to construct the controller 30 to calculate the difference of the detected values of the four pressure sensors 1 and determine that an abnormal vibration has occurred when the difference is greater than a reference value also after the start of the extracting process.

[Embodiment 2]

Figure 7:
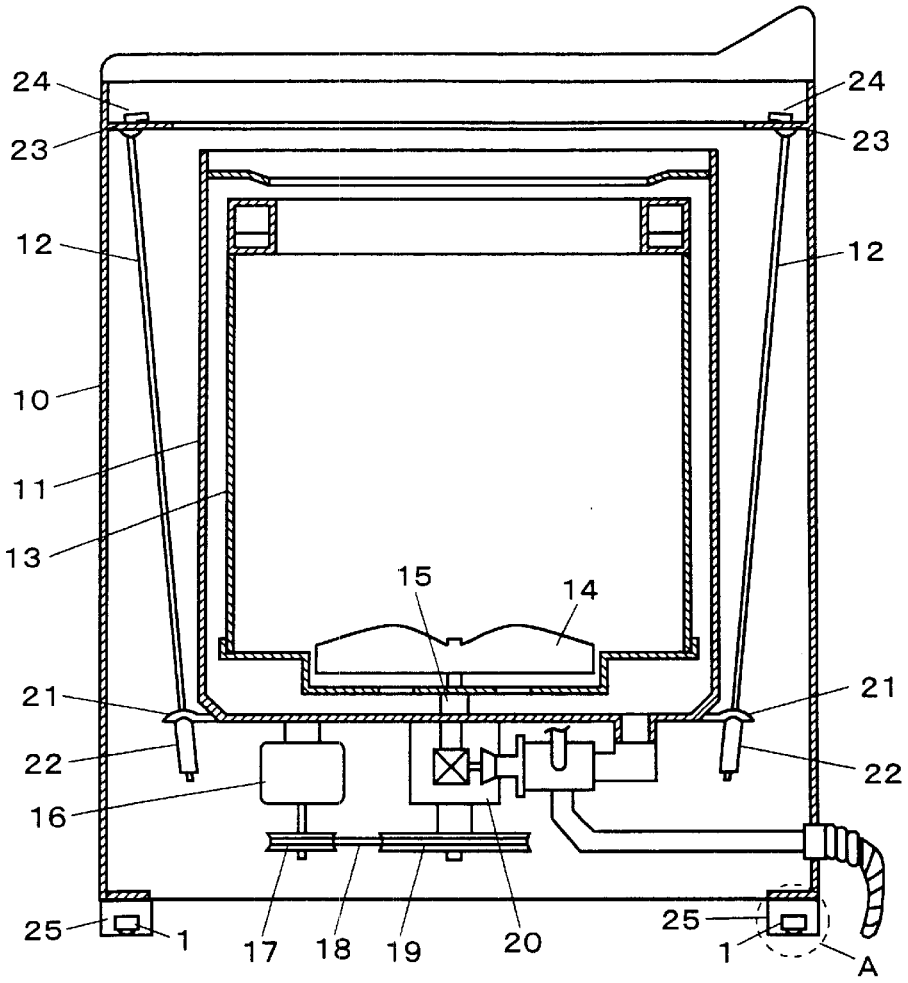
FIG. 7 shows a vertical section of a washing machine of Embodiment 3.
Figure 8:
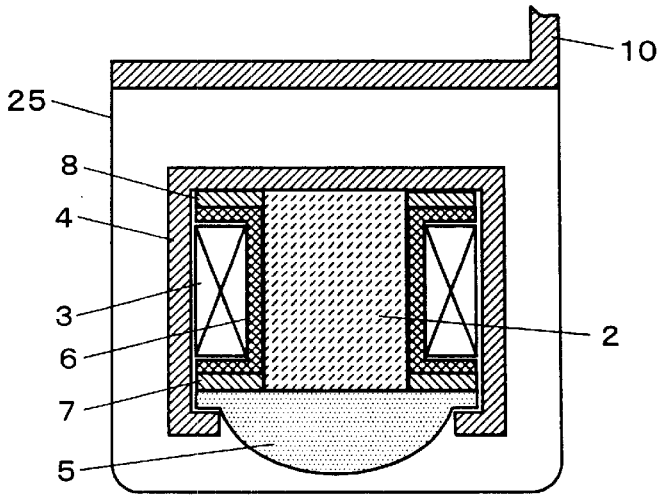
FIG. 8 is an enlarged view of the part A of FIG. 7.

The second embodiment of the present invention is described. FIG. 7 shows a vertical cross section of the washing machine of Embodiment 2, and FIG. 8 is an enlarged view of part A of FIG. 7. In the washing machine of Embodiment 1, the pressure sensors are provided at the four rod holding parts. In the washing machine of Embodiment 2, the pressure sensors 1 are attached at the four feet 25 provided at the corners of the bottom of the body housing 10. The foot 25 is an elastic part made of rubber or the like to prevent the vibration of the body housing 10 from being transmitted to the floor. The pressure sensor 1 is enclosed in the foot 25 with its hemispherical receptor 5 being directed downwards (to face the floor). Each of the four feet 25 bears a share of the whole weight of the washing machine, and each of the four pressure sensors 1 receives an external force corresponding to the share of the whole weight. Thus, the only difference between the washing machine of Embodiment 2 and that of Embodiment 1 lies in whether the external force includes the weight of the parts that are not suspended by the suspension rods 12. So, it is possible to detect the weight of the laundry, the water level, and the eccentric load during the extracting process and/or the vibration in the same manner as in Embodiment 1 .

[Embodiment 3]

The third embodiment of the present invention is described. In the washing machine of Embodiment 1, it is necessary to use four pressure sensors 1 since all rod holding parts 24 are provided with the sensors. The washing machine of Embodiment 3, on the other hand, is constructed so that the weight of the laundry, the weight of water, etc., are detected based on the output of a single pressure sensor 1 provided at one of the rod holding part 24.

Figure 6:
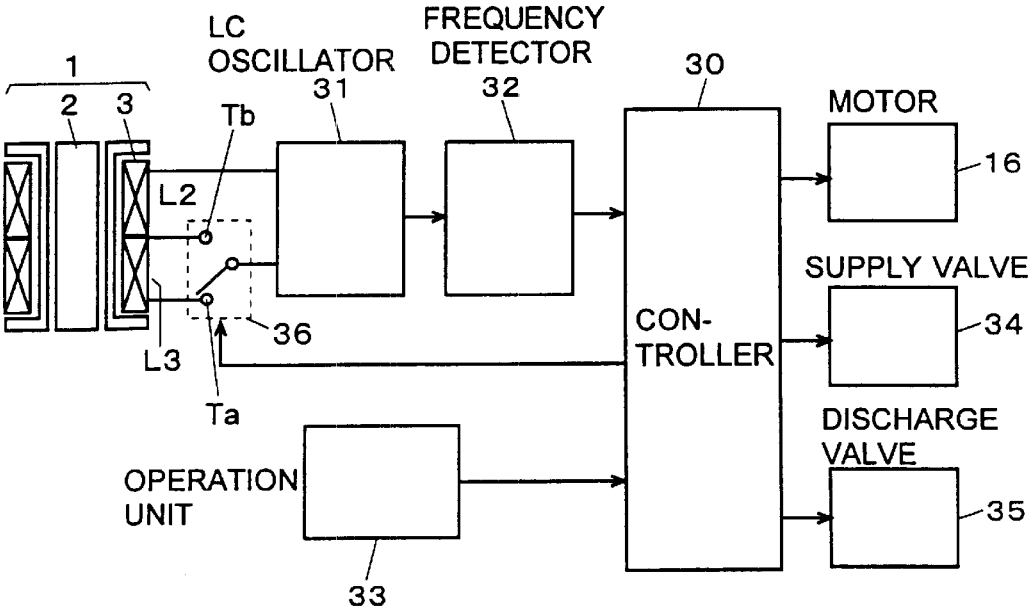
FIG. 6 shows the electrical system of the main part of the washing machine of Embodiment 3.

FIG. 6 shows the electrical system of the main part of the washing machine of Embodiment 3. In the pressure sensor 1 of this washing machine, the coil 3 is divided into two sub-coils having the same number of turns (300, for example) for allowing a selection of sensitivity as described above. When the switch 36 is turned to a terminal Ta, the two subcoils are connected in series, so that the number of turns of the coil 3 is 600. When the switch 36 is turned to the other terminal Tb, only the first sub-coil is enabled, so that the number of turns of the coil 3 is 300. As understood from FIG. 2, when the number of turns is small, the sensitivity is lowered because the amount of change in the inductance is small as a whole.

Figure 9:
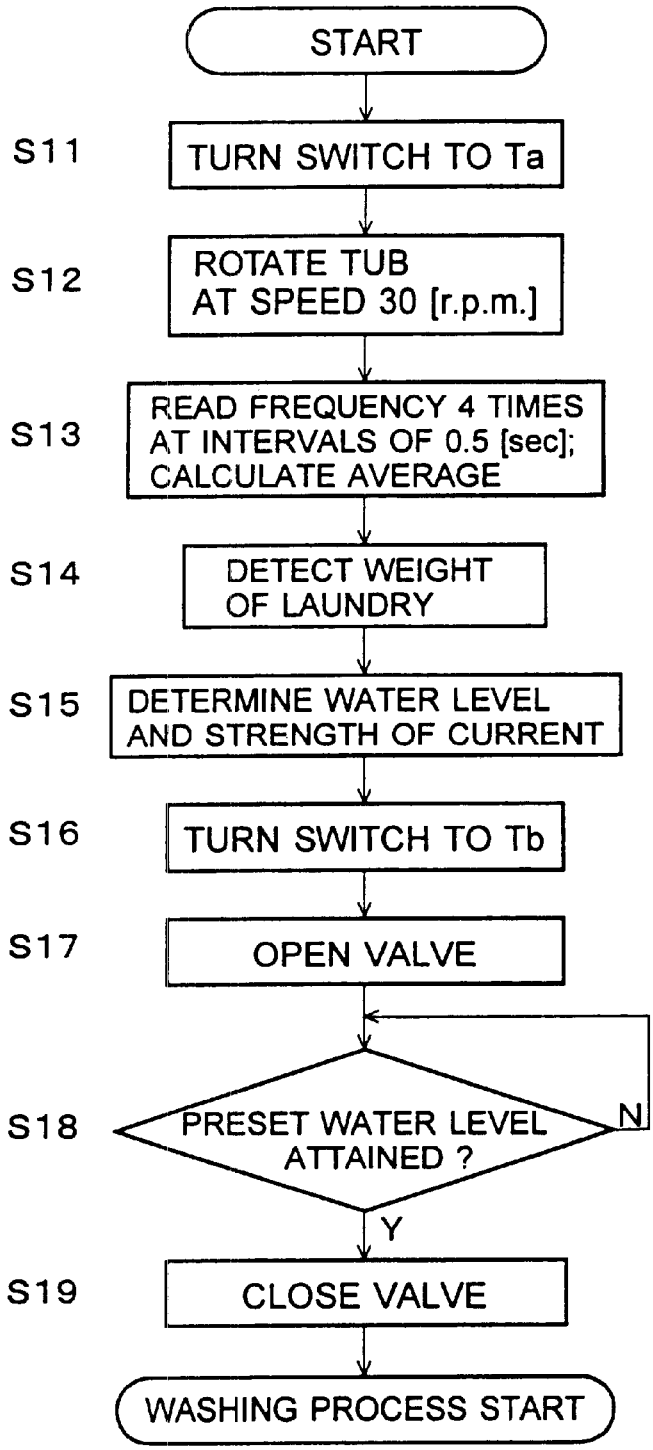
FIG. 9 is a flowchart showing control steps of the washing machine of Embodiment 3 from the start of the operation to the start of the washing process.

FIG. 9 is a flowchart showing control steps of the washing machine of Embodiment 3 from the start of the operation to the start of the washing process. When the user commands the controller 30 to start the operation, the controller 30 turns the switch 36 to the terminal Ta so that the number of turns of the coil 3 of the pressure sensor 1 becomes 600(Step S11). After that, the controller 30 drives the motor 16 to rotate the laundry tub 13 at 30[r.p.m.] (Step S12). That is, it takes about two seconds for the laundry tub 13 to make a rotation.

The controller 30 reads the frequency values from the frequency detector 32 four times at intervals of 0.5 second, or once in every quarter rotation of the laundry tub 13, and calculates the average of the four frequency values (Step S13). Then, based on the average, the controller 30 makes the above-described determination relating to the weight of the laundry (Step S14).

After that, the controller 30 determines the water level and the strength of water current (Step S15), and turns the switch 36 to the terminal Tb so that the number of turns of the coil 3 becomes 300(Step S16). As a result, the sensitivity of the pressure sensor 1 is set lower as described above. After that, the control proceeds through Steps S17-S19, where water is supplied to a preset water level as in Steps S3-S5 of FIG. 5, and the washing process is started. Thus, even with a single pressure sensor 1, it is possible to obtain plural detection values obtained while rotating the laundry tub 13 and make the determination relating to the weight of the laundry and/or the weight of water based on the average of the detected values. By such a method, the weight can be detected correctly with less influence from an uneven distribution of the laundry.

Figure 10:
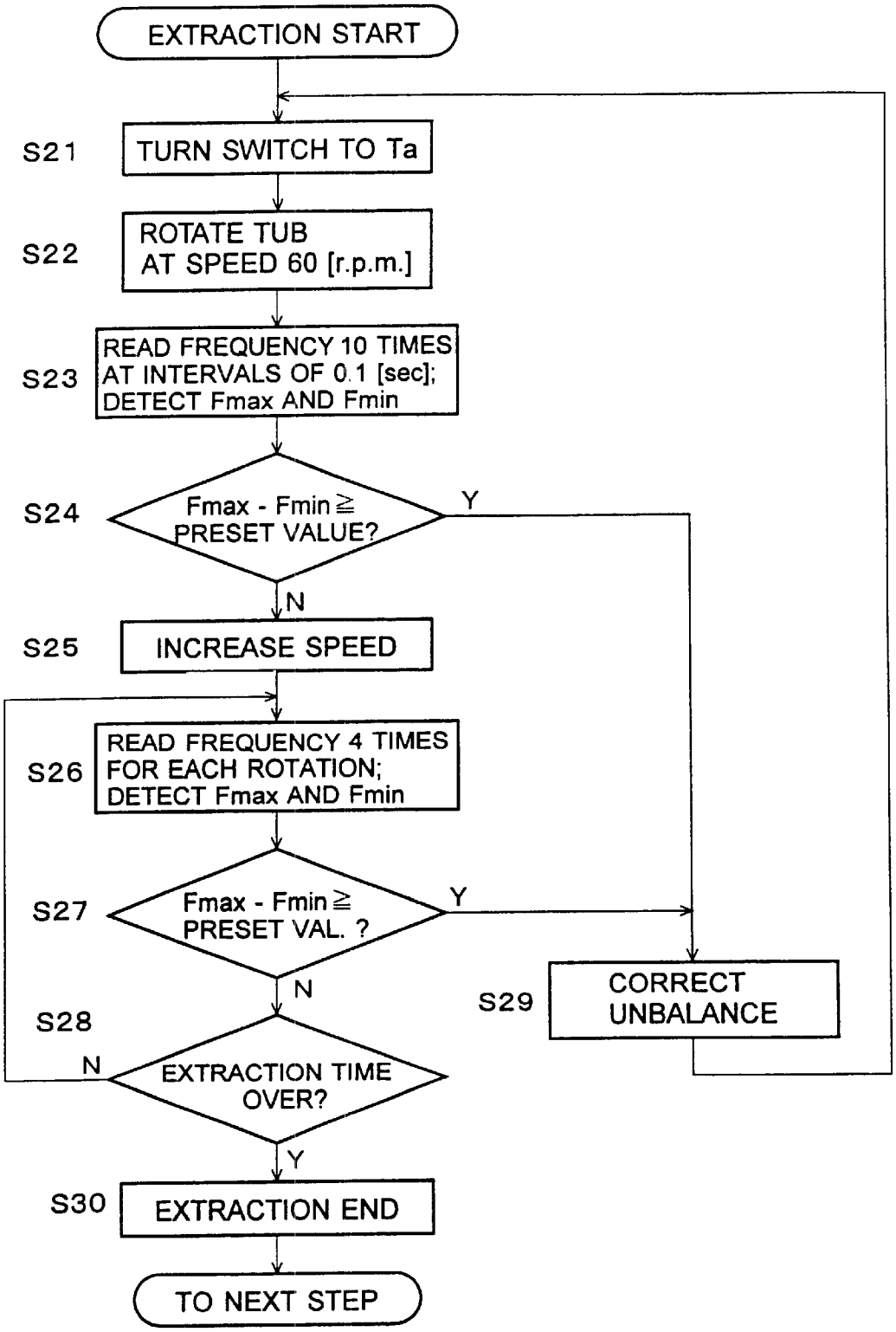
FIG. 10 is a flowchart showing steps of the extracting phase by the washing machine of Embodiment 3.

FIG. 10 is a flowchart showing control steps of the extracting process of the washing machine of Embodiment 3. When the extracting process is started subsequent to the washing and rinsing process, the controller 30 turns the switch 36 to the terminal Ta so that the number of turns of the coil becomes 600(Step S21). After that, the controller 30 drives the motor 16 to rotate the laundry tub 13 at 60[r.p.m.] (Step S22). That is, it takes about one second for the laundry tub to make a rotation. The controller 30 reads the frequency values from the frequency detector 32 ten times at intervals of 0.1 second, or once in every 36 degrees of rotation of the laundry tub 13, and detects the maximum value Fmax and the minimum value Fmin of the ten frequency values (Step S23). Then, the controller 30 calculates the difference between Fmax and Fmin, and determines whether the difference is greater than a first reference value (Step S24). If the eccentric load due to the uneven distribution of the laundry is large, the change in the detected value of the pressure sensor 1 during one turn of the laundry tub 13 is also large. So, in Step S24, when the difference is greater than the first reference value, the controller 30 judges that the eccentric load is abnormally large, and carries out an unbalance-correcting operation (Step S29).

In Step S24, when the difference between Fmax and Fmin is less than the first reference value, the controller 30 increases the speed of the laundry tub 13 (Step S25). While increasing the speed, the controller 30 reads the frequency values from the frequency detector 32 four times in every rotation or once in every quarter rotation of the laundry tub 13, and detects the maximum value Fmax and the minimum value Fmin (Step S26). In accordance with the increase in the speed of the laundry tub 13, the time interval of reading the frequency value from the frequency detector 32 is controlled to be shorter. Then, the controller 30 calculates the difference between Fmax and Fmin, and determines whether the difference is greater than a second reference value (Step S27). If the vibration of the outer tub 11 becomes greater in the course of increasing the speed of the laundry tub 13, the change in the detected value of the pressure sensor 1 during one rotation of the laundry tub 13 also becomes larger. So, when the difference is greater than the second reference value, the controller 30 judges that the eccentric load is abnormally large, and carries out the unbalance-correcting operation (Step S29). When, in Step S27, the difference between Fmax and Fmin is less than the second reference value, the controller checks whether a preset extraction time is over (Step S28). When the period is not over, the control returns back to Step S26, and when the period is over, the extracting process ends (Step S30).

As has already been explained, the object of the unbalance-correcting operation is to loosen and redistribute the laundry. For example, the operation may include steps of stopping the laundry tub 13 temporarily, supplying water into the outer tub 11 and rotating pulsator 14. This is of course a mere example and the unbalance-correcting operation may be carried out in some other way so long as the above object is met. Thus, even with a single pressure sensor 1, the eccentric load or vibration due to an uneven distribution of the laundry can be detected.

[Embodiment 4]

The fourth embodiment of the washing machine is described below. The washing machine of Embodiment 4 includes a pressure sensor 1 provided at one of the rod holding parts, as in Embodiment 3, and a different detection circuit for detecting the weight of the laundry, the water level and the vibration with the pressure sensor 1.

Figure 11:
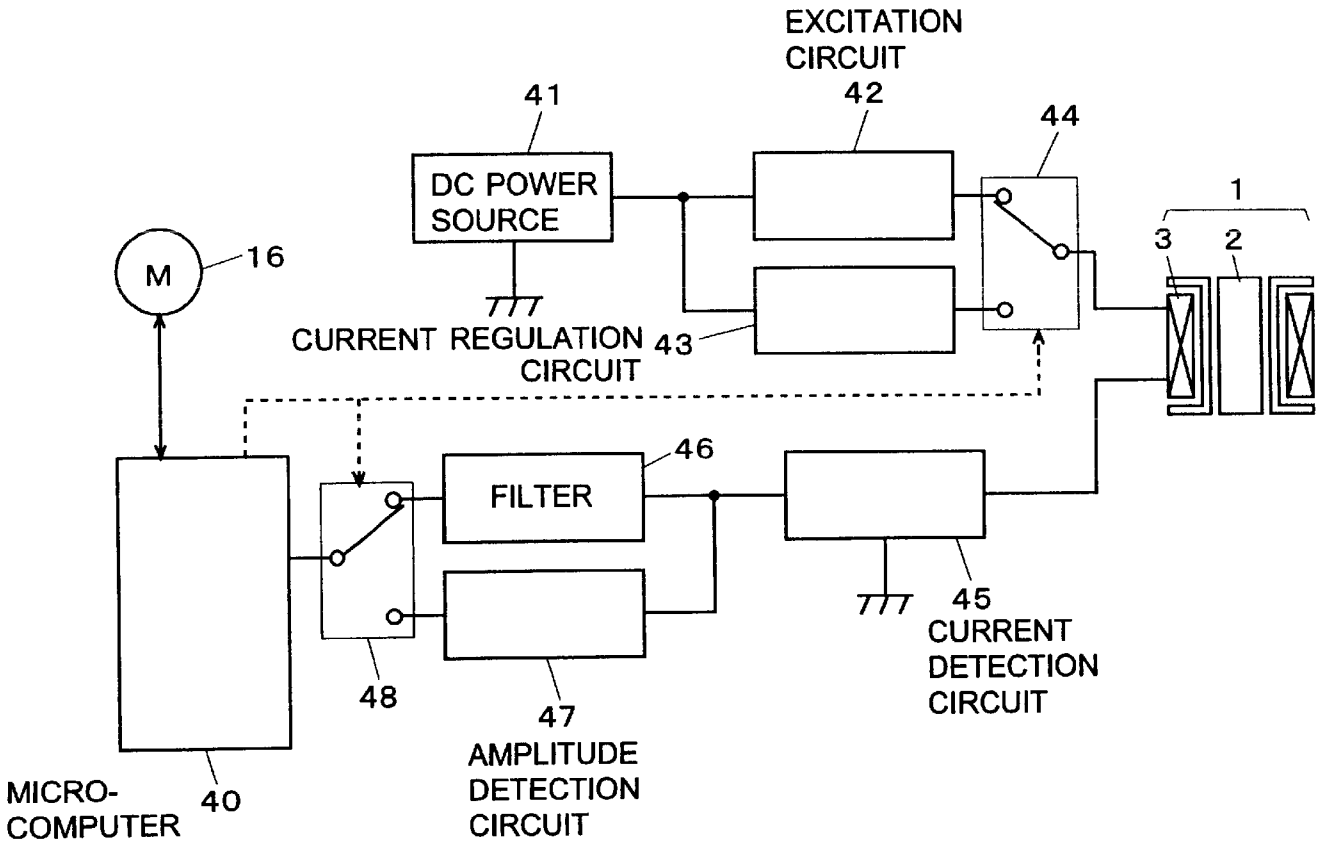
FIG. 11 shows the electrical system of the main part of the washing machine of Embodiment 4.

FIG. 11 shows the electrical system of the main part of the washing machine of Embodiment 4. In FIG. 11, the detection circuit includes: a DC power source 41; an excitation circuit 42 and a current-regulation circuit 43 connected to the DC power source 41;

a first switch 44 for selecting electric current to be supplied to the coil 3 wound around the core 2; a current detection circuit 45 and an amplitude detection circuit 47 connected to the output of the coil 3; and a second switch 48 for selecting a signal to be supplied to the microcomputer 40. The value of the speed of the motor 16 is sent to the microcomputer 40, which controls the switching of the two switches based on the speed. When the motor 16 is halted, the microcomputer 40 turns the switches 44 and 48 to the upper terminals shown in FIG. 11 (weight-measuring mode), and when the motor 16 is rotating, the microcomputer turns the switches 44 and 48 to the lower terminals shown in FIG. 11 (vibration-measuring mode).

In the weight-measuring mode, the DC voltage generated by the DC power source 41 is switched at a preset cycle by the excitation circuit 42 and becomes a square wave. The square wave is supplied via the switch 44 to the coil 3 of the pressure sensor 1. Here, when the pressure onto the core 2 increases due to, for example, the laundry put into the laundry tub 13, the permeability of the core 2 changes according to the pressure, and the impedance of the coil 3 also changes. As a result, the amount of current supplied from the coil 3 to the current detection circuit 45 changes, and the current detection circuit 45 the detects the change. The current detection circuit 45 is constructed to produce an output voltage corresponding to the amount of current detected. The output voltage is sent via a low-pass filter to the microcomputer 40. The microcomputer 40 determines the load on the pressure sensor 1 based on the voltage, and water is supplied into the outer tub 11 by an amount corresponding to the load.

In the vibration-measuring mode, the current regulation circuit 43 produces a constant DC current. The DC current is supplied via the switch 44 to the coil 3 and produces a magnetic field passing through the core 2. Here, when the laundry tub 13 vibrates, the permeability of the core 2 changes as in the case of the weight-measuring mode, and an induced electromotive force is generated there. As understood from the formula (1) shown below, the induced voltage V is proportional to the compression force which the core 2 experiences due to the vibration, and the amplitude of the induced voltage V is greater as the changing rate is higher or the vibration frequency is higher.

$$V=-N(d\phi/dt) \quad (1)$$

where N denotes number of turns.

The amplitude detection circuit 47 detects the amplitude of the induced voltage, and the voltage value is sent to the microcomputer 40 as an analogue voltage value. The microcomputer 40 converts the analogue voltage value into digital data and determines whether an abnormal rotation due to the uneven distribution of the laundry is present. For example, the microcomputer 40 compares the digital value to a preset threshold value. When the digital value is greater than the threshold value, the microcomputer 40 determines that the rotation is abnormal due to the eccentric load, and controls each part to stop the laundry tub 13 or reduce its speed. The threshold value is determined beforehand at the beginning of the operation corresponding to the weight of the laundry put into the laundry tub 13. The threshold value is set higher as the load on the outer tub 11 is greater due to the laundry. Even when the vibration (or rate of change in the acceleration) is the same, the change in the force detected by the pressure sensor 1 increases if the total weight of the outer tub 11, the laundry tub 13 and the laundry put in it changes. On the contrary, when the load is small, the threshold value is set low. By changing the threshold value according to the load as described above, the abnormal rotation can be detected with high accuracy. Thus, the damage or breakdown of parts of the washing machine due to abnormal rotation is prevented.

[Embodiment 5]

The washing machine of Embodiment 4 is constructed so that the weight-measuring mode or the vibration-measuring mode is selected according to the rotation of the motor 16.

Figure 12:
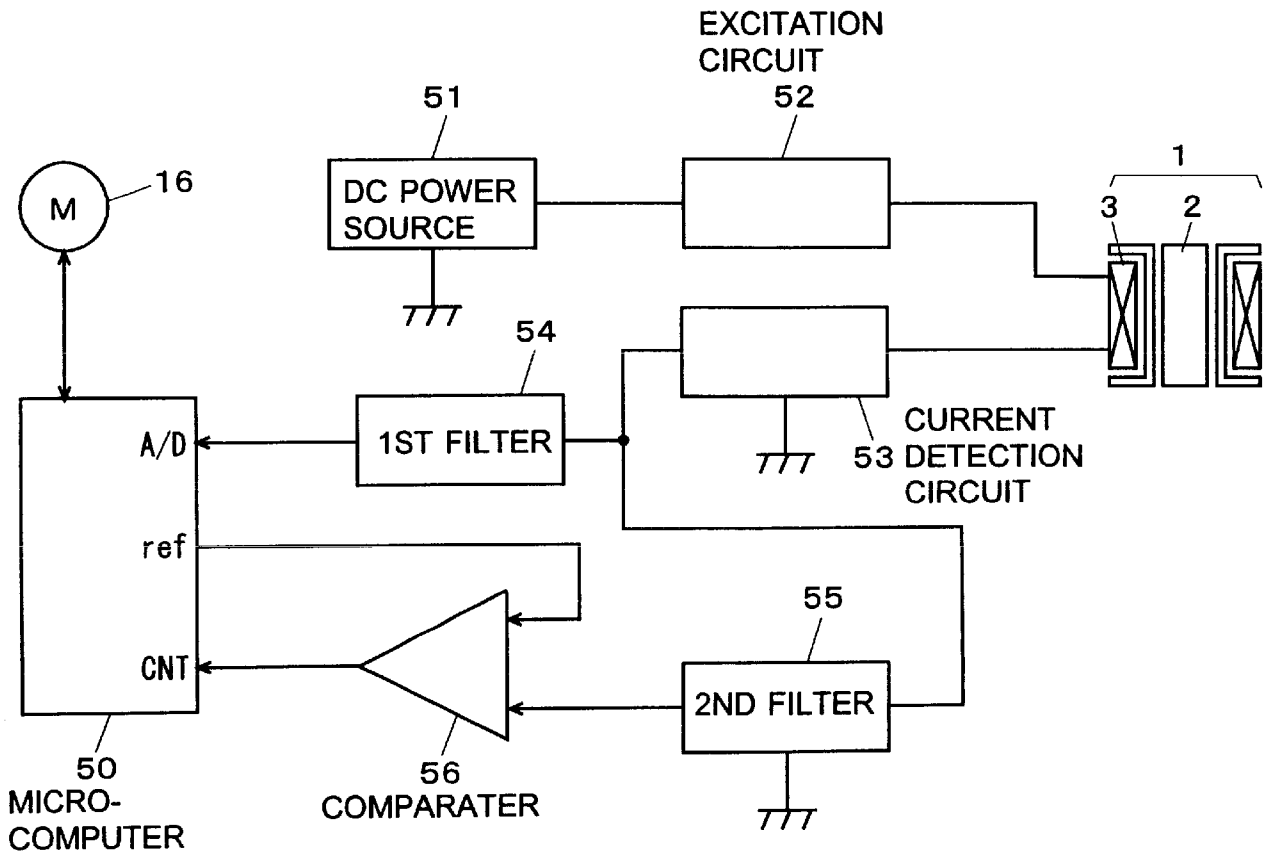
FIG. 12 shows the electrical system of the main part of the washing machine of Embodiment 5.

The washing machine of the fifth embodiment includes a detection circuit constructed so that the load and the vibration are measured simultaneously. FIG. 12 shows the electrical system of the main part of the washing machine of Embodiment 5. The detection circuit includes: a DC power source 51; an excitation circuit 52 connected to the output of the DC power circuit 51; a current detection circuit 53 connected to the output of the coil 3 of the pressure sensor 1; a first low-pass filter 54 used for detecting the weight and a second low-pass filter 55 used for detecting the vibration; and a comparater 56 connected to the output of the second low-pass filter 55 and a reference signal output terminal (ref) of a microcomputer 50. Here, the oscillation frequency of the excitation circuit 52 is 10kHz, the cutoff frequency of the first low-pass filter 54 is 100Hz, and the cutoff frequency of the second low-pass filter is 1kHz.

Receiving the DC voltage from the DC power source 51, the excitation circuit 52 produces a square wave having a frequency of 10kHz, which is supplied to the coil 3 of the pressure sensor 1. Here, whether the laundry tub 13 is halted or rotating, the inductance of the coil 3 is changing according to the compression force exerted on the core 2. As a result, the amount of current supplied from the coil 3 to the current detection circuit 53 changes, and the current detection circuit 53 detects the change. The current detection circuit 53 is constructed to produce an output voltage corresponding to the amount of current detected.

The output voltage is transferred via the first low-pass filter 54 to an A/D conversion terminal of the microcomputer 50. In the microcomputer 50, the voltage is converted to digital signal, and the load on the core 2 is measured. The load is used in the determination of the amount of water to be supplied into the outer tub 11. First, the amount of water to be supplied is preset according to the load, and the water supply is started. Then, the amount of water in the outer tub 13 is monitored based on the load on the outer tub 13. When the monitored amount of water has attained the determined amount, the water supply is stopped.

Further, the microcomputer 50 generates a reference signal based on the load measured, and the reference signal is transferred from the output terminal (ref) to one of the input terminals the comparater 56. The reference signal is a voltage indicative of a load that is 1.5 times as high as the load measured. Meanwhile, the output voltage of the current detection circuit 53 is also transferred via the second low-pass filter 55 to another input terminal of the comparater 56, and is compared to the reference signal given from the microcomputer 50. When the amplitude of the output voltage wave of the second low-pass filter 55 exceeds the amplitude of the reference signal, the comparater 56 generates an output signal. This signal is sent to a terminal (CNT) of the microcomputer 50 and counted there. When the count of the signals within a preset period of time has exceeded a predetermined threshold value, the microcomputer 50 determines that the rotation is abnormal, and controls each part to stop the motor 16 or reduce its speed. Thus, the damage or breakdown of parts of the washing machine due to abnormal rotation is prevented.

In the washing machine of Embodiment 5, the load acting on the outer tub 11 and the vibration of the outer tub 11 are measured at the same time, whether the laundry tub 13 is rotating or not. Therefore, even when the load changes along with a lapse of time during the extracting process, the abnormal rotation of the laundry tub 13 is detected assuredly. Also, since the load on the outer tub 11 is monitored throughout the rotation of the laundry tub 13, the washing machine of Embodiment 5 may be constructed so that the state of extraction of the laundry in the laundry tub 13 is determined based on the change in the load during the extracting process. In this case, the rotation of the laundry tub 13 can be controlled with respect to the state of extraction of water from the laundry, so that the extraction can be controlled appropriately.

[Embodiment 6]

In the washing machines of Embodiments 4 and 5, the abnormal rotation due to an eccentric load on the laundry tub 13 is detected based on the magnitude of vibration transmitted from the outer tub 11 via the damper 22 to the pressure sensor 1. In the washing machine of the sixth embodiment, the abnormal rotation due to an eccentric load on the laundry tub 13 is detected based on the change in the load on the pressure sensor 1 caused by a collision of the outer tub 11 with the suspension rod 12.

Figure 13:
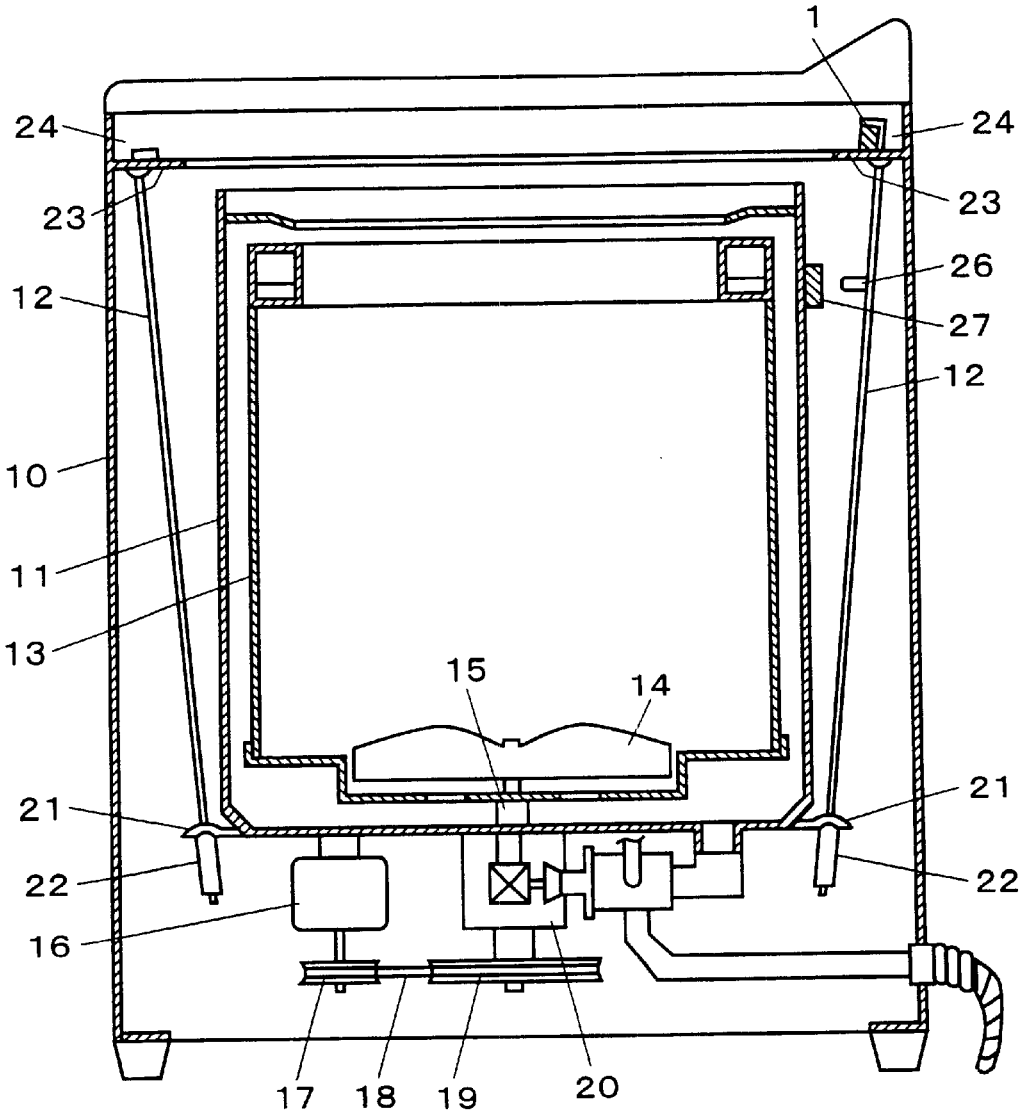
FIG. 13 shows a vertical section of a washing machine of Embodiment 6.

Referring to FIG. 13, the suspension rod 12 of the washing machine of Embodiment 6 is provided with a projection 26 standing toward the outer tub 11. The projection 26 is designed to have a length such that the projection 26 touches the outer tub 11 at a tilting angle of the outer tub 11 smaller than the minimum of all tilting angle at which the outer tub 11 collides with the body housing 10. According to such a construction, when the outer tub 11 is tilted due to an eccentric load on the laundry tub 13, the outer tub 11 collides with the projection 26. The shock of the collision is transmitted via the suspension rod 12 to the pressure sensor 1, where the compression force changes.

Figure 14:
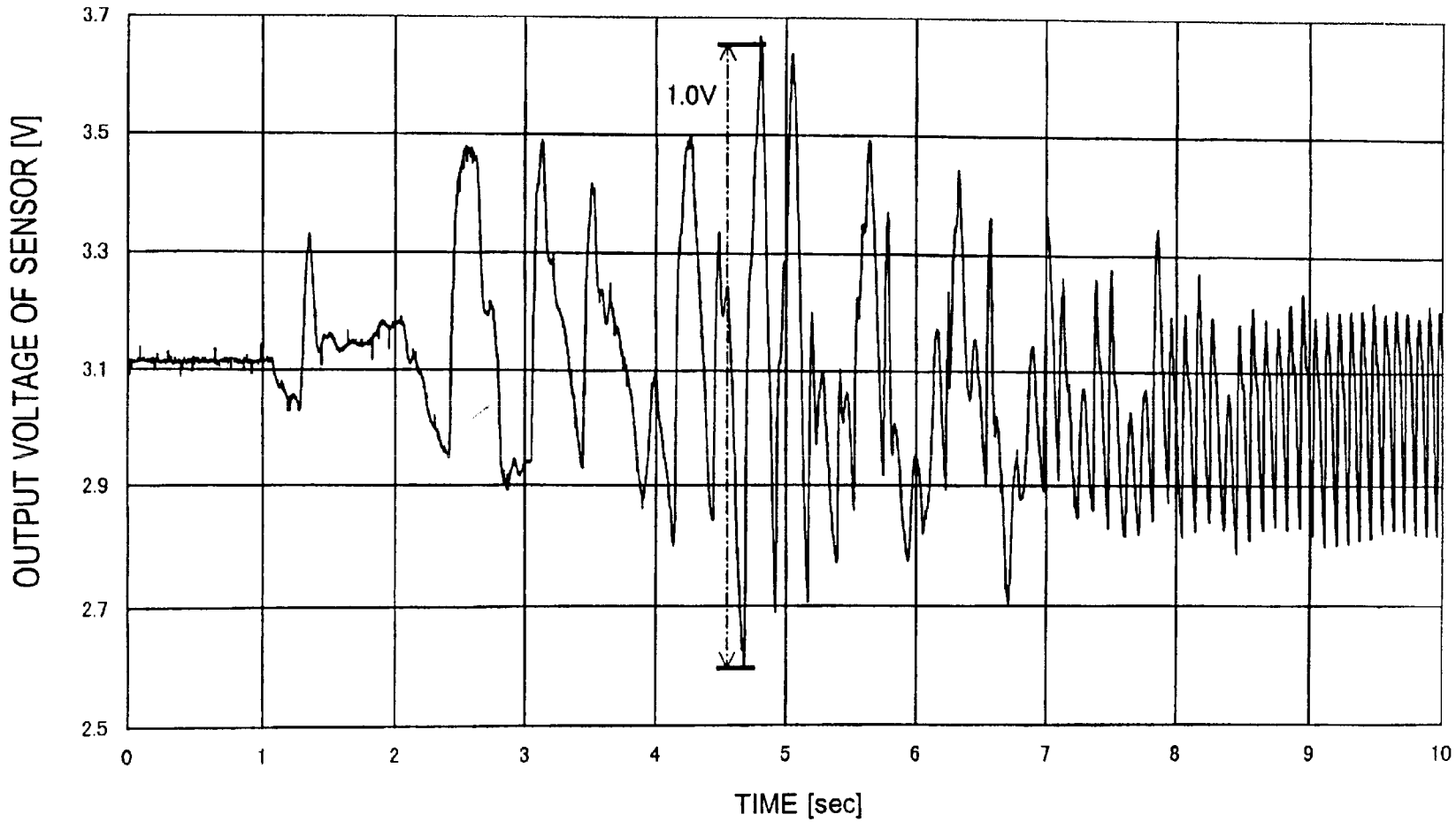
FIG. 14 is a graph showing a voltage measured during an extracting process by a washing machine having a suspension rod with a projection, where the extracting process is carried out with an eccentric load on the laundry tub.
Figure 15:
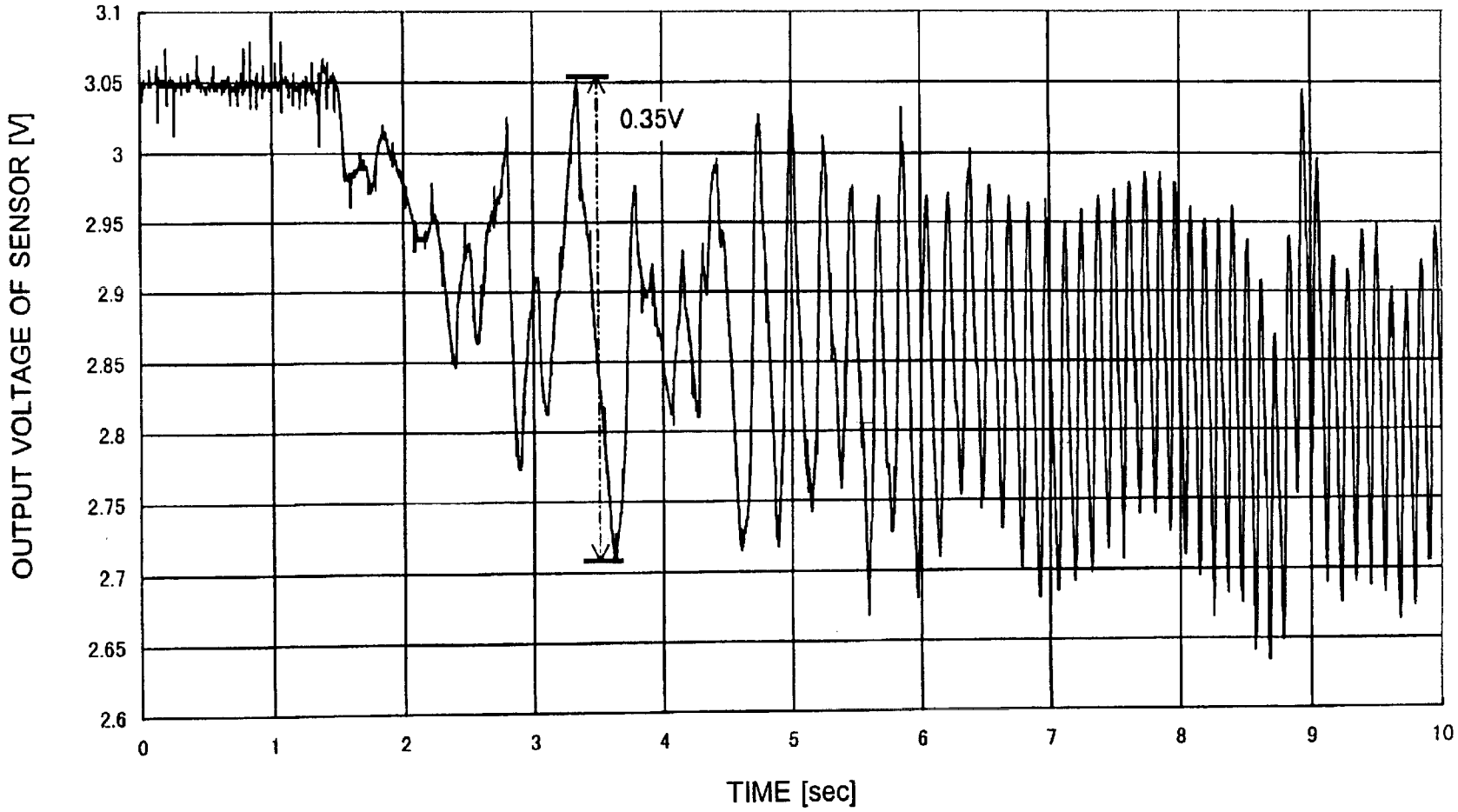
FIG. 15 is a graph showing a voltage measured during an extracting process by a washing machine having a suspension rod with no projection, where the extracting process is carried out with an eccentric load on the laundry tub.

With the washing machine having the suspension rod 12 with the projection 26 as described above, when the extracting process, where the laundry tub 13 is rotated at high speed, is carried out with a weight of I kilogram attached eccentrically on the laundry tub 13, the maximum amplitude of the output voltage of the pressure sensor 1 is about 1.0V, as shown in FIG. 14. With the washing machine where no projection is provided with the suspension rod 12, on the other hand, when the extracting process is carried out similarly with the weight of 1 kilogram attached eccentrically on the laundry tub 13, the maximum amplitude of the output voltage of the pressure sensor 1 is about 0.35V, as shown in FIG. 15. Thus, the detection signal is greatly amplified by providing the projection 26. According to such a construction, the vibration due to an abnormal rotation can be clearly distinguished from the vibration due to the normal rotation, so that an abnormal rotation can be detected more assuredly. Also, in the washing machine of Embodiment 6, a thick part 27 is formed in the wall of the outer tub 11 at a part where the projection 26 of the suspension rod 12 collides with the wall. According to such a construction, the strength of the outer tub 11 is improved, so that the dent or wear of the outer tub 11 due to the collision with the projection 26 of the suspension rod 12 is alleviated.

In Embodiments 4–6, only one pressure sensor 1 is provided at one of the suspension rods 12 provided at the four corners of the body housing 10. It is of course possible to provide two pressure sensors 1 at a pair of the suspension rods 12 placed diagonally, or to provide four pressure sensors 1 at all the suspension rods 12, as in Embodiment 1. Also, it is possible to provide the pressure sensor 1 between the suspension rod 12 and the outer tub 11 instead of providing it between the suspension rod 12 and the body housing 10.

[Embodiment 7]

Figure 16:
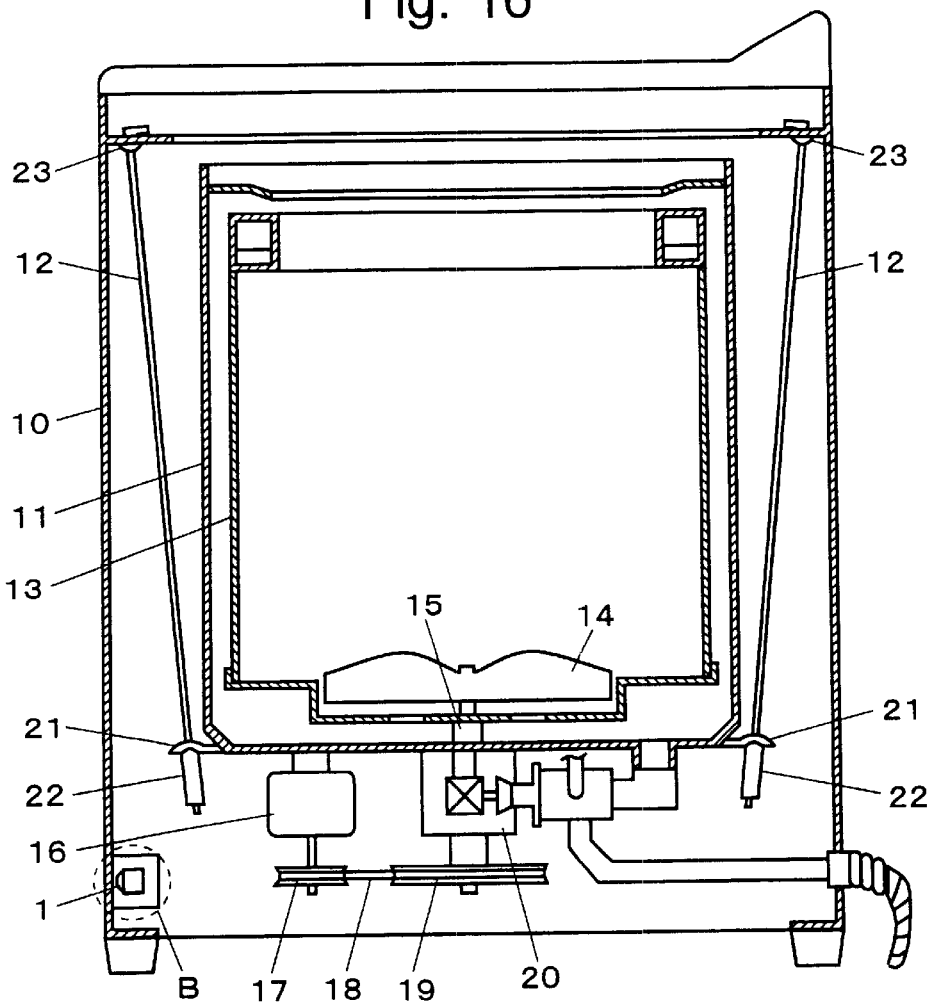
FIG. 16 shows a vertical section of a washing machine of Embodiment 7.
Figure 17:
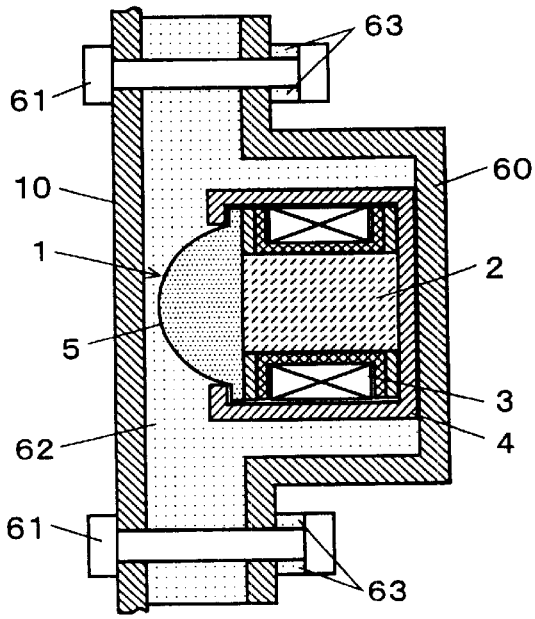
FIG. 17 is an enlarged view of the part B of FIG. 16.

The seventh embodiment (which is referred to as Embodiment 7) of the washing machine is described. The washing machine of Embodiment 7 is constructed so that the pressure sensor 1 is utilized for detecting only the eccentric load and/or abnormal vibration. FIG. 16 shows a vertical cross section of the washing machine, and FIG. 17 is an enlarged view of the part B of FIG. 16. The electrical system of this washing machine is the same as shown in FIG. 4 or 6, so that it is not described in detail below.

The pressure sensor 1 is enclosed in an elastic member 62 made of rubber or the like and is placed between a pressing plate 60 and a side plate of the body housing 10. The pressing plate 60 is secured to the body housing 10 with bolts 61 that penetrate them, with the elastic member 63 in-between. When the body housing 10 vibrates, an external force is exerted on the receptor 5 the of pressure sensor 1 because the pressure sensor 1 does not follow the vibration with the completely same phase or amplitude. The larger the vibration of the body housing 10 is, the larger the external force is, and the inductance of the coil 3 changes according to the magnitude of the vibration. The vibration of the body housing 10 occurs when the pulsator 14 rotates as in the case of washing or rinsing process as well as when the pulsator 14 and the laundry tub 13 rotate together.

Figure 18:
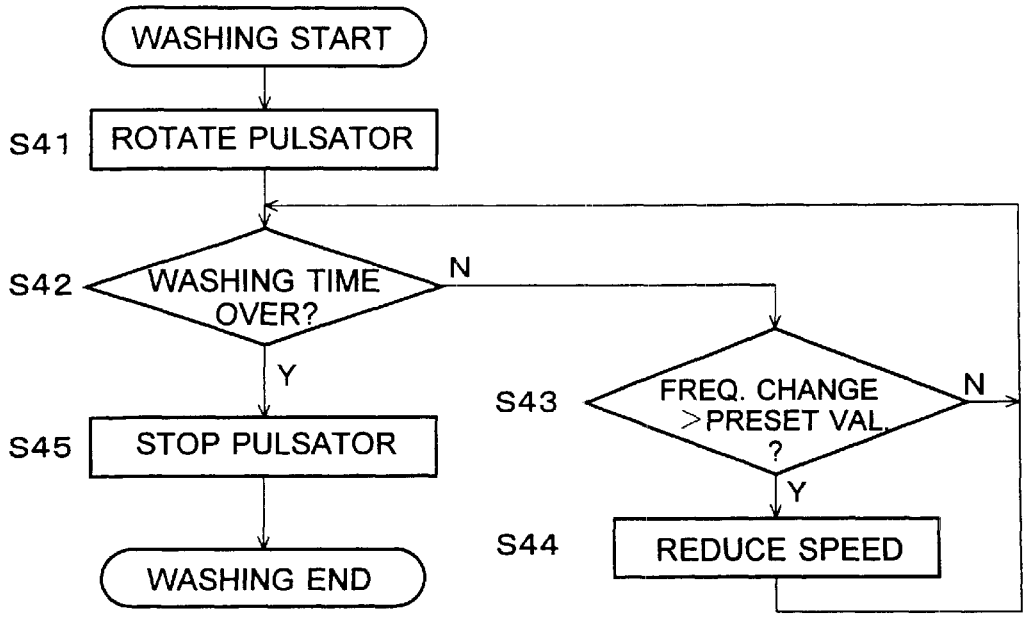
FIG. 18 is a flowchart showing steps of the washing phase by the washing machine of Embodiment 7.

FIG. 18 is a flowchart showing control steps of the washing machine of Embodiment 7 during the washing process. After a start of the washing process, when the pulsator 14 is rotated at a preset speed (Step S41), water current is generated in the laundry tub 13, and the laundry not only rotates around the pulsator 14 but also moves vertically. Until the lapse time attains a preset washing time period (or until the result in Step S42 turns to Yes), the controller 30 detects the change in the detection frequency read from the frequency detector 32. When the change is greater than a preset amount (or when the result in Step S43 is Yes), the controller 30 reduces the speed of the motor 16 (Step S44). Thus, the speed of the pulsator 14 is reduced, and the strength of water current is weakened. As a result, the vibration of the body housing 10 is reduced. When the change is less than the preset amount in Step S43, the controller 30 determines that no abnormal vibration is present, and the control returns to Step S42. When the preset washing time period is attained in Step S42, the controller 30 stops the pulsator 14 (Step S45). Thus, the washing process is over.

Figure 19:
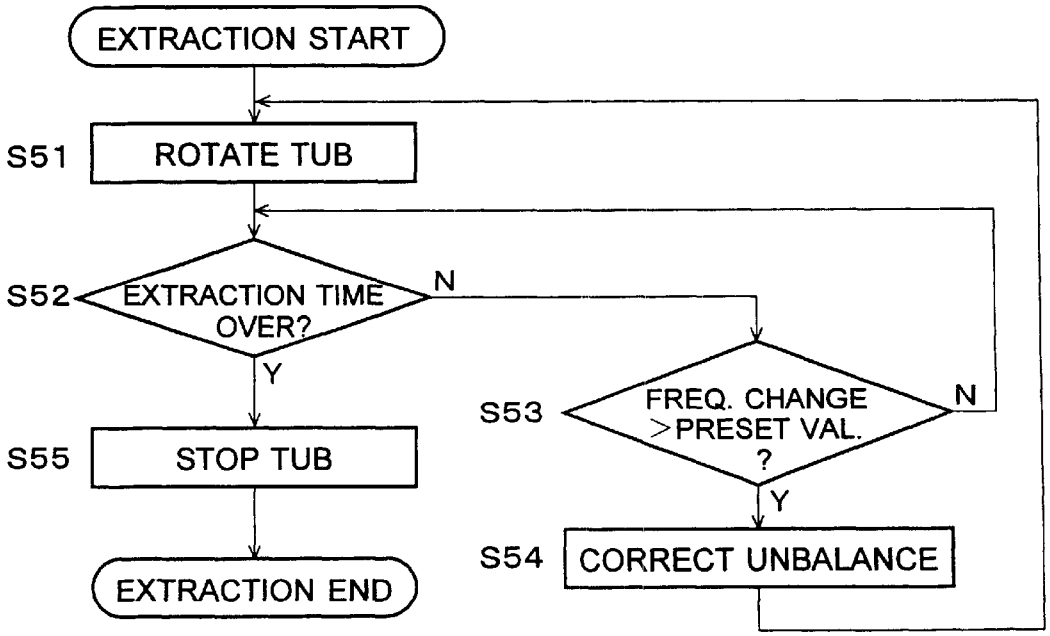
FIG. 19 is a flowchart showing steps of the extracting phase by the washing machine of Embodiment 7.

FIG. 19 is a flowchart showing control steps of the extracting process of the washing machine of Embodiment 7. After a start of the extracting process, when the motor 16 is turned on, the speed of the laundry tub 16 increases gradually (Step S51). Until the lapse time attains a preset extraction time period (or until the result in Step S52 turns to Yes), the controller 30 detects the change in the detection frequency read from the frequency detector 32. When the change is greater than a preset amount (or when the result in Step S53 is Yes), the above-described unbalance-correcting operation is carried out (Step S54). After the unbalance-correcting operation, the control returns to Step S51, where the extracting process is started again. When the change is less than the preset amount in Step S53, the controller 30 determines that no abnormal vibration is present, and the control returns to Step S52.

When the preset extraction time period is attained in Step S52, the controller 30 stops the laundry tub 13 (Step S55). Thus, the extracting process is over.

As described above, according to the present invention, the pressure sensor using a magnetostrictive element may be placed at various parts of the washing machine in order to detect the weight of the laundry, the weight of water, the eccentric load or the vibration. It should be obvious that the above embodiments are mere examples and they may be further modified or changed within the scope of the present invention. For example, in any of the above embodiments, the present invention is applied to a so-called whirlpool-type automatic washing machine having a rotatable laundry tub mounted on a vertical shaft, and it is obvious that the present invention may be applied to a drum-type washing machine having a rotatable drum mounted on a horizontal shaft. Also, the present invention may be applied to a drumtype drying machine constructed similar to the drum-type washing machine.

What is claimed is:

1. A washing machine, comprising a body housing;

an outer tub suspended in the body housing;

a wash-and-extraction tub rotatably provided in the outer tub;

a pressure sensor placed at a position where it experiences an external force due to a weight of a laundry contained in the wash-and-extraction tub and a weight of water supplied therein, wherein the pressure sensor includes at least one of a single coil and a plurality of coils constructing a coil assembly whose inductance is variable by selecting one, some or all of the coils;

a measuring part for measuring the weight of the laundry and the weight of the water based on an output of the coil of the pressure sensor; and an operation controller for determining an object amount of water to be supplied into the outer tub according to the weight of the laundry before the water is supplied, for monitoring the weight of water with the measuring part, and for controlling the water supply with respect to the object amount of water while the water is being supplied.

2. The washing machine according to claim 1, wherein the pressure sensor is provided in at least one of rod holders holding suspension rods suspending the outer tub, and a load on the suspension rod is detected by the pressure sensor.

3. The washing machine according to claim 2, wherein the pressure sensor is provided in every rod holder.

4. The washing machine according to claim 1, wherein the pressure sensor is provided in at least one of feet supporting the washing machine on a floor, and a load on the one of the feet is detected by the pressure sensor.

5. The washing machine according to claim 4, wherein the pressure sensor is provided in at least one of the feet but not in all of them.

6. The washing machine according to claim 5, wherein the load is detected by the pressure sensor a plurality of times while rotating the laundry tub at low speed and the measuring part infers the weight of the laundry, weight of water, eccentric load or vibration based on the plurality of detected values.

* * * * *